US009069292B2

(12) United States Patent
Kitta

(10) Patent No.: US 9,069,292 B2
(45) Date of Patent: Jun. 30, 2015

(54) DEVELOPMENT DEVICE AND IMAGE FORMATION APPARATUS

(71) Applicant: Oki Data Corporation, Tokyo (JP)

(72) Inventor: Takuya Kitta, Tokyo (JP)

(73) Assignee: Oki Data Corporation, Tokyo (JP)

( * ) Notice: Subject to any disclaimer, the term of this patent is extended or adjusted under 35 U.S.C. 154(b) by 10 days.

(21) Appl. No.: 13/969,639

(22) Filed: Aug. 19, 2013

(65) Prior Publication Data

US 2014/0056610 A1 Feb. 27, 2014

(30) Foreign Application Priority Data

Aug. 27, 2012 (JP) ..... 2012-186106

(51) Int. Cl.
*G03G 15/08* (2006.01)

(52) U.S. Cl.
CPC ..... *G03G 15/0898* (2013.01)

(58) Field of Classification Search
USPC ..... 399/102, 103, 105
See application file for complete search history.

(56) References Cited

U.S. PATENT DOCUMENTS 6,405,003 B2 * 6/2002 Uehara ..... 399/103
7,668,481 B2 * 2/2010 Kawai ..... 399/103
7,983,590 B2 * 7/2011 Sakuma ..... 399/102
2004/0190929 A1 * 9/2004 Yoshiki ..... 399/103
2006/0204273 A1 * 9/2006 Kawai ..... 399/103
2008/0199210 A1 * 8/2008 Inaba et al. ..... 399/103
2013/0071138 A1 * 3/2013 Goto ..... 399/103

FOREIGN PATENT DOCUMENTS

JP 2004-004930 A 1/2004
JP 2007-193065 A 8/2007
JP 2010-032957 A 2/2010

* cited by examiner

*Primary Examiner* — Clayton E Laballe
*Assistant Examiner* — Warren K Fenwick
(74) *Attorney, Agent, or Firm* — Marvin A. Motsenbocker; Mots Law, PLLC

(57) ABSTRACT

A developer storage device includes a rotation member including a shaft portion protruding from a main body thereof; a support member formed with a hole by which the shaft portion is supported; and a first seal member disposed between the main body of the rotation member and the support member and including a hole into which the shaft portion is inserted. The support member includes a step portion. The step portion includes a first restraint section which restrains motion of the first seal member in an axial direction of the shaft portion, and a second restraint section which restrains motion of the outer periphery of the first seal member in a radial direction of the shaft portion.

22 Claims, 10 Drawing Sheets

DEVELOPMENT DEVICE AND IMAGE FORMATION APPARATUS

CROSS REFERENCE TO RELATED APPLICATIONS

This application claims priority based on 35 USC 119 from prior Japanese Patent Application No. 2012-186106 filed on Aug. 27, 2012, entitled "DEVELOPMENT DEVICE AND IMAGE FORMATION APPARATUS", the entire contents of which are incorporated herein by reference.

BACKGROUND OF THE INVENTION

Field of the Invention

The disclosure relates to a development device and an image formation apparatus.

In a conventional image formation apparatus for a copying machine, a printer, a facsimile machine, a multi function printer (MFP) or the like which uses an electrophotographic process, a development device uses a toner supply roller including a roller section formed such that a silicon sponge is wound around a shaft member. The toner supply roller is rotated to supply toner to a development roller so that a toner layer having a sufficient thickness is formed on the surface of the development roller and the sufficient amount of the toner is supplied to an electrostatic latent image formed on the surface of a photosensitive drum to develop an image.

The shaft member of the toner supply roller is rotatably supported at both end portions thereof by a frame of the development device. In the toner supply roller, a seal member made of a sponge is disposed between the frame of the development device and each of the end portions of the roller section in order to prevent the toner from leaking out. In addition, for the purpose of securely sealing a gap between the frame and the end portion of the roller section, it is also proposed to provide the seal member with a ring-shaped projection part formed on a surface thereof (for example, refer to Patent Literature 1: Japanese Patent Application Publication No. 2010-32957).

SUMMARY OF THE INVENTION

In the conventional development device, however, the toner having entered the gap between the end portion of the roller section and the seal member leaks out to the outside in some cases.

An object of an embodiment of the invention is to securely prevent the developer from leaking out.

An aspect of the invention is a developer storage device that includes: a rotation member including a main body thereof and a shaft portion which protrudes from an end portion of the main body; a support member formed with a hole by which the shaft portion is supported; and a first seal member disposed between the main body of the rotation member and the support member and including a hole into which the shaft portion is inserted. The support member includes a step portion that includes: a first restraint section which restrains motion of the first seal member in an axial direction of the shaft portion; and a second restraint section which restrains motion of the outer periphery of the first seal member in a radial direction of the shaft portion.

With the aspect of the invention, it is possible to securely prevent the developer from leaking out.

DETAILED DESCRIPTION OF EMBODIMENTS

Figure 1:
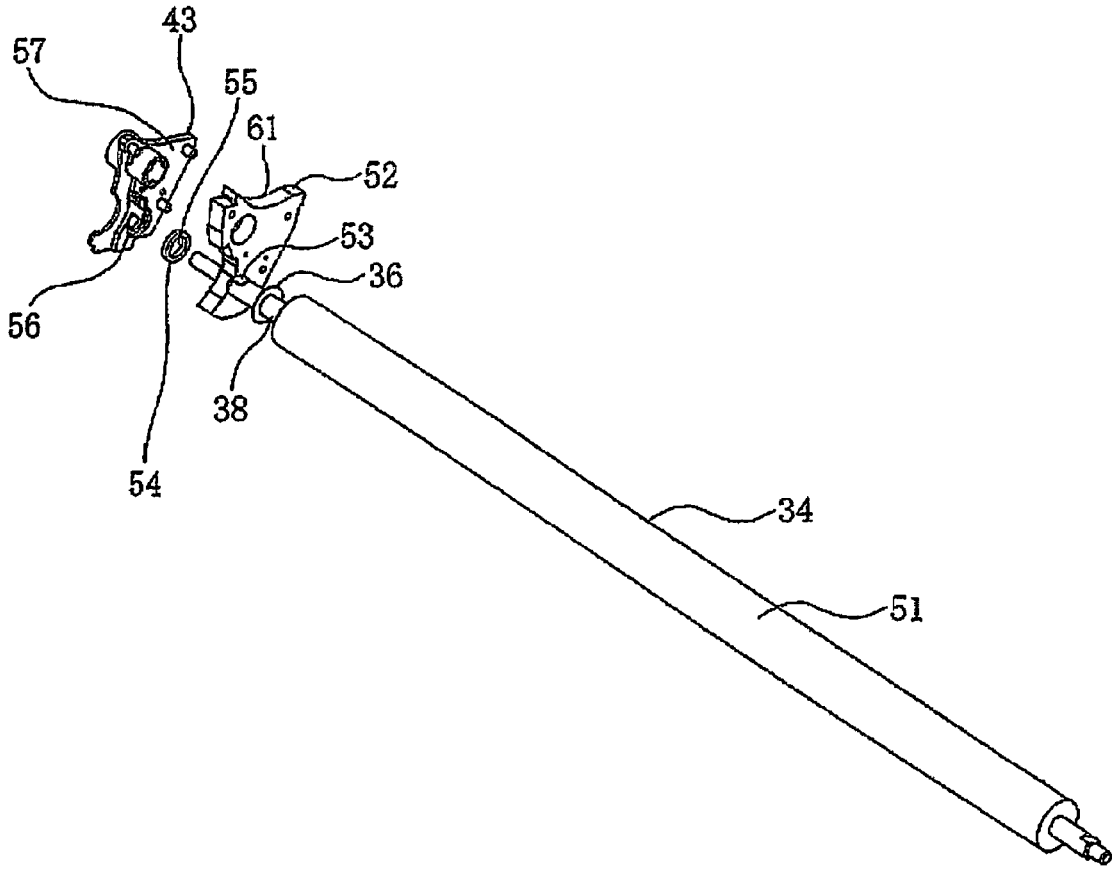
FIG. 1 is an exploded view illustrating a relevant portion of a development device serving as a developer storage device according to a first embodiment of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Hereinafter, embodiments of the invention are described in detail with reference to the drawings.

Figure 2:
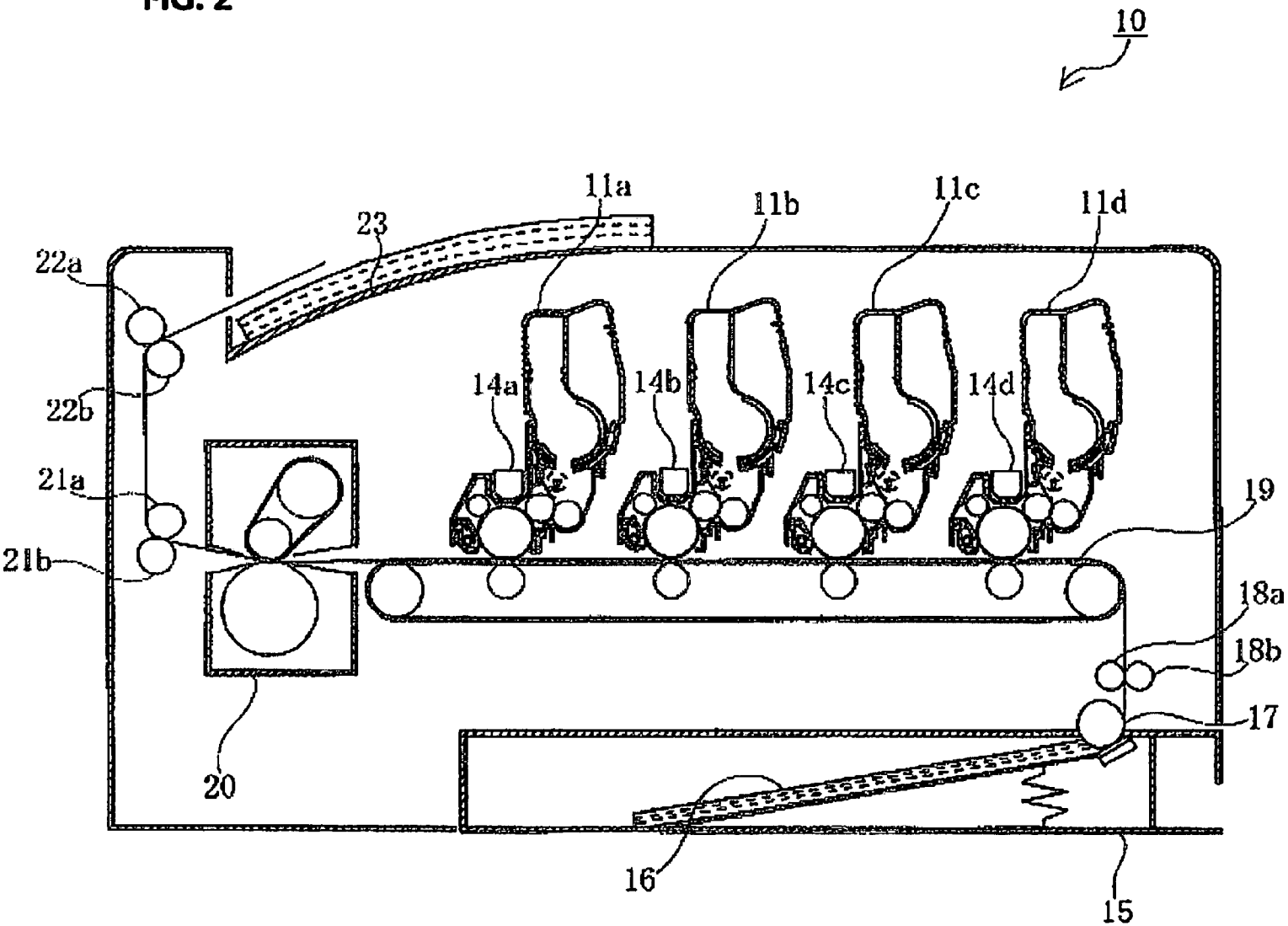
FIG. 2 is a schematic view illustrating the configuration of an image formation apparatus according to the first embodiment of the invention.
Figure 3:
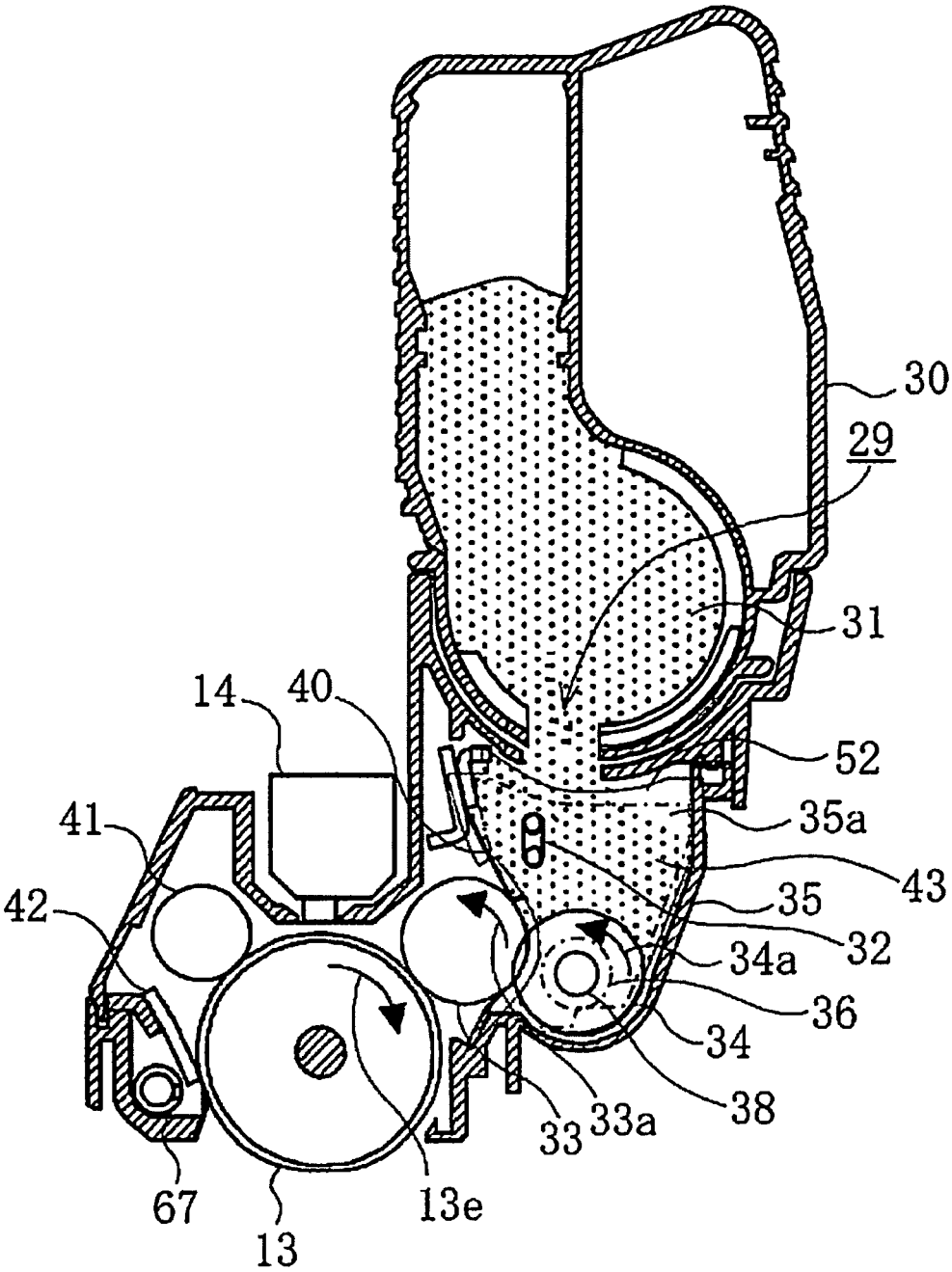
FIG. 3 is a schematic view illustrating the configuration of the development device according to the first embodiment of the invention.

FIG. 2 is a schematic view illustrating the configuration of an image formation apparatus according to a first embodiment of the invention, and FIG. 3 is a schematic view illustrating the configuration of a development device serving as a developer storage device according to the first embodiment of the invention.

In FIG. 2, 10 denotes an image formation apparatus. Although the image formation apparatus is an electrophotographic printer, facsimile machine, copying machine, or an MFP having functions of the printer, the facsimile machine, and the copying machine, for example, any types of image formation apparatuses may be employed. Note that, in this embodiment, the described image formation apparatus 10 is a so-called color electrophotographic printer of a tandem system.

Further, in image formation apparatus 10, development devices 11*a*, 11*b*, 11*c*, and 11*d* respectively correspond to four colors of C (cyan), M (magenta), Y (yellow), and K (black) and are arranged side by side along a conveyance path of media 16. Note that, development devices 11*a*, 11*b*, 11*c*, and 11*d* serving as developer storage devices have the same configuration, but store a toner, that is a developer (developer 31, FIG. 3), having a color respectively corresponding to the four different colors. Moreover, exposure heads 14*a*, 14*b*, 14*c*, and 14*d*, serving as exposure devices respectively corresponding to the four colors, are respectively disposed in development devices 11*a*, 11*b*, 11*c*, and 11*d*. When development devices 11*a*, 11*b*, 11*c*, and 11*d* and exposure heads 14*a*, 14*b*, 14*c*, and 14*d* are described in an integrated manner, they are referred to as development device 11 and exposure head 14.

Here, 15 denotes a media tray which stores media 16 such as sheets of recording paper, 17 denotes a separation roller for separating medium 16 one by one from media tray 15 and sends medium 16 out, 18*a* and 18*b* denote conveyance rollers which convey medium 16 thus sent out, and 19 denotes a transfer belt which conveys medium 16 to allow a developer image to be transferred onto medium 16. Further, medium 16 conveyed by conveyance rollers 18*a* and 18*b* and sent to transfer belt 19 is applied with an electrostatic charge, is adsorbed to transfer belt 19 by an electrostatic force, and then is conveyed by transfer belt 19. During the conveyance, a developer image is formed in development device 11.

Moreover, 20 denotes a fixing unit serving as a fuser for fixing the developer image transferred onto medium 16 to medium 16 by heat and pressure; 21*a*, 21*b*, 22*a*, and 22*b* denote discharge rollers for conveying and discharging medium 16, to which the developer image is fixed to the outside of the apparatus; and 23 denotes a stacker cover which holds medium 16 thus discharged.

Further, development device 11 includes, as illustrated in FIG. 3, chassis 35, and developer storage container 30 which is attached above chassis 35 and stores developer 31. Moreover, developer hopper 35*a* is formed in chassis 35, and supply port 29 is formed on the ceiling face of developer hopper 35*a*. Further, developer 31 in developer storage container 30 is supplied to the inside of developer hopper 35*a* through supply port 29, and is temporally stored in developer hopper 35*a*. Moreover, chassis 35 includes frame 43 serving as a support section or a support member.

Moreover, rotatable photosensitive drum 13 serving as an image carrier is attached to chassis 35, and rotates in the direction indicated by arrow 13*e*. Around photosensitive drum 13, disposed are charge roller 41, exposure head 14, rotatable development roller 33 serving as a developer carrier, cleaning blade 42, and spiral 67. Further, developer 31 on development roller 33, which rotates in the direction indicated by arrow 33*a*, is thin-layered by development blade 40, and is supplied to an electrostatic latent image formed on the surface of photosensitive drum 13.

The rotatable supply roller denoted by 34 serves as a rotation member or a roller member, rotates in the direction indicated by arrow 34*a*, and supplies developer 31 to development roller 33. Moreover, both end portions of supply roller 34 in the rotational axis direction are sealed by washer 36 mounted on the end portion. Second sponge 52 is held by frame 43 and serves as a second seal member, and the like, thereby preventing developer 31 from leaking out from the end portion. Further, a stir member 32 which stirs developer 31 is disposed in developer hopper 35*a*.

Next, the configuration of a relevant portion of development device 11 is described.

Figure 4:
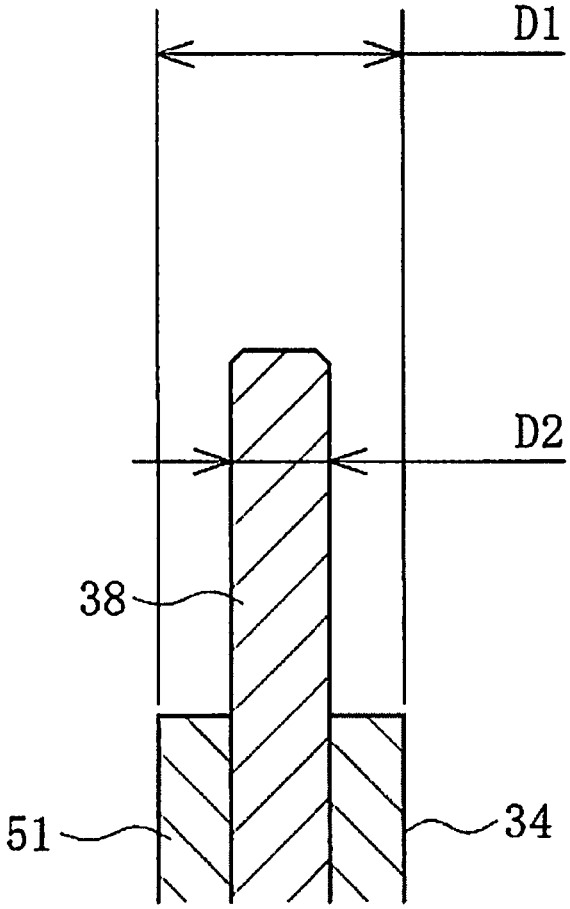
FIG. 4 is a cross-sectional view of a supply roller of the development device according to the first embodiment of the invention.
Figure 5:
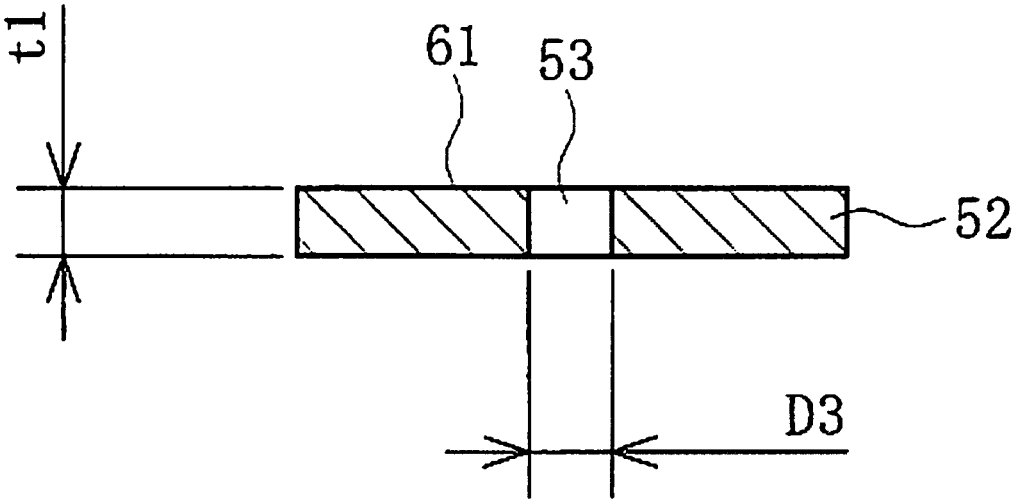
FIG. 5 is a cross-sectional view of a second sponge of the development device according to the first embodiment of the invention.
Figure 6:
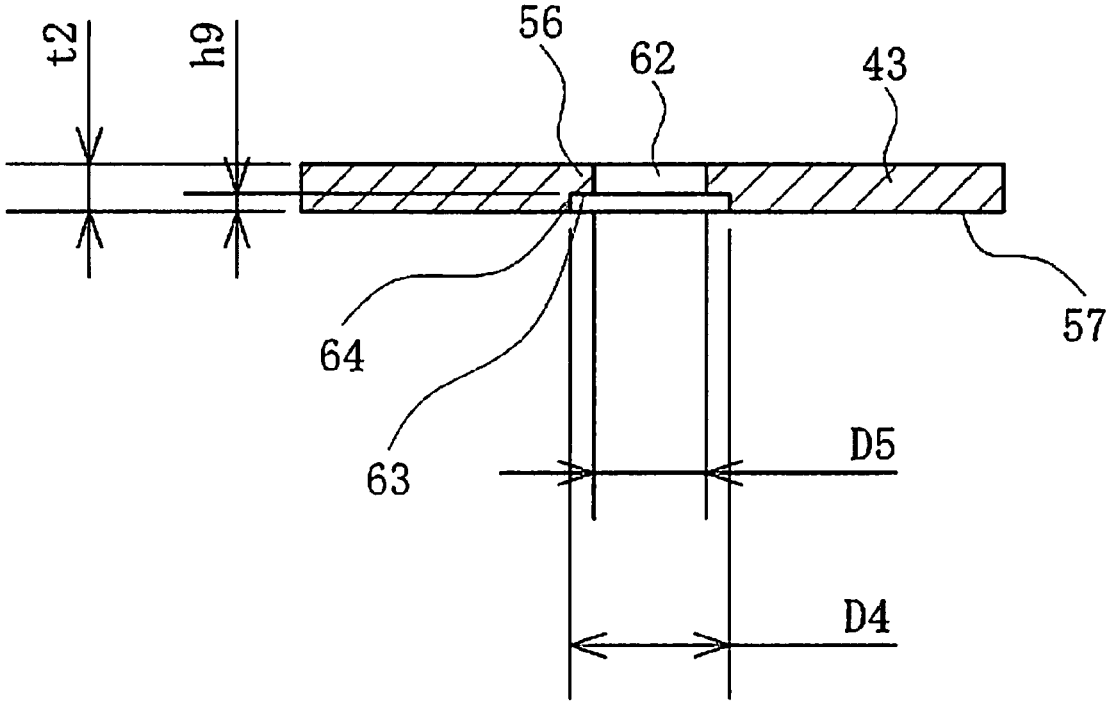
FIG. 6 is a cross-sectional view of a frame of the development device according to the first embodiment of the invention.
Figure 7:
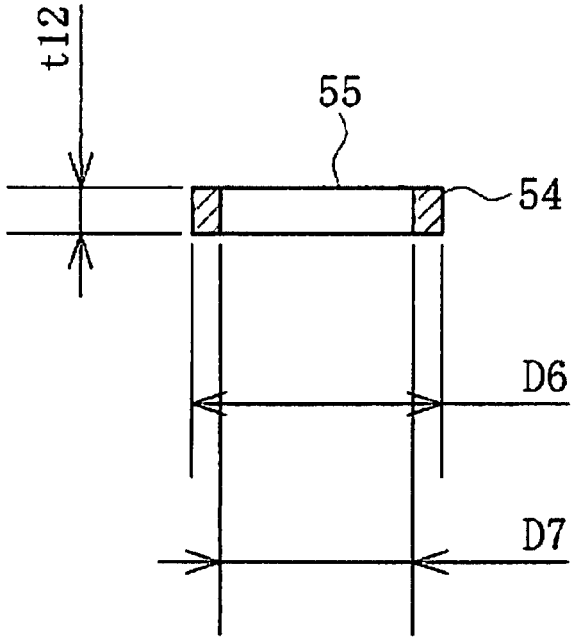
FIG. 7 is a cross-sectional view of a first sponge of the development device according to the first embodiment of the invention.
Figure 8:
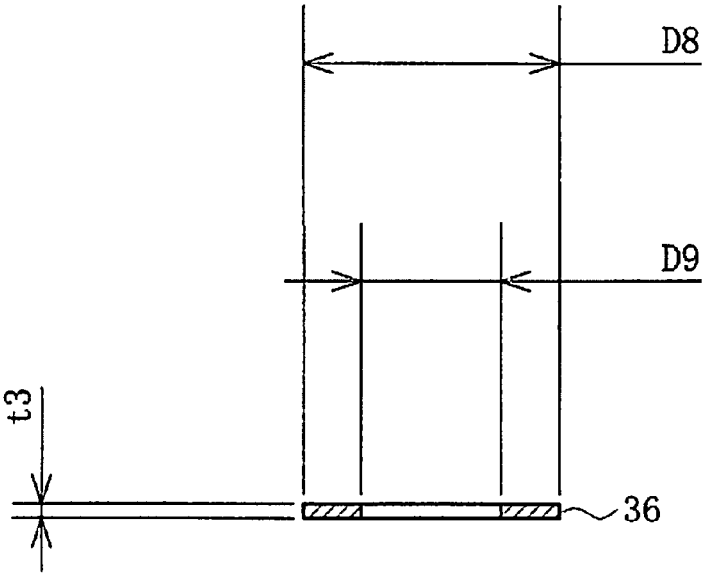
FIG. 8 is a cross-sectional view of a washer of the development device according to the first embodiment of the invention.
Figure 9:
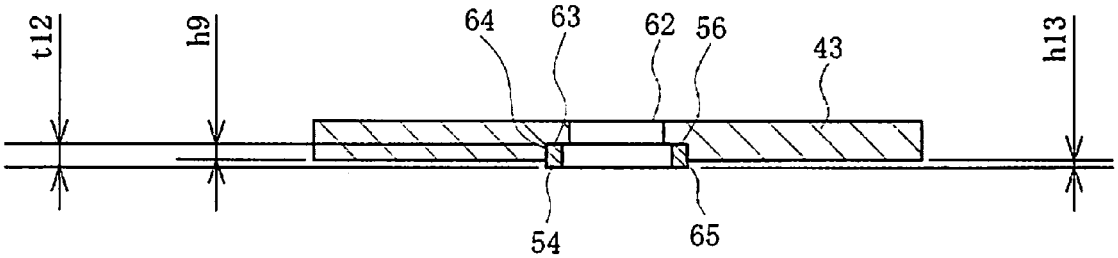
FIG. 9 is a cross-sectional view illustrating the state where the first sponge of the development device is held by a step portion of the frame according to the first embodiment of the invention.
Figure 10:
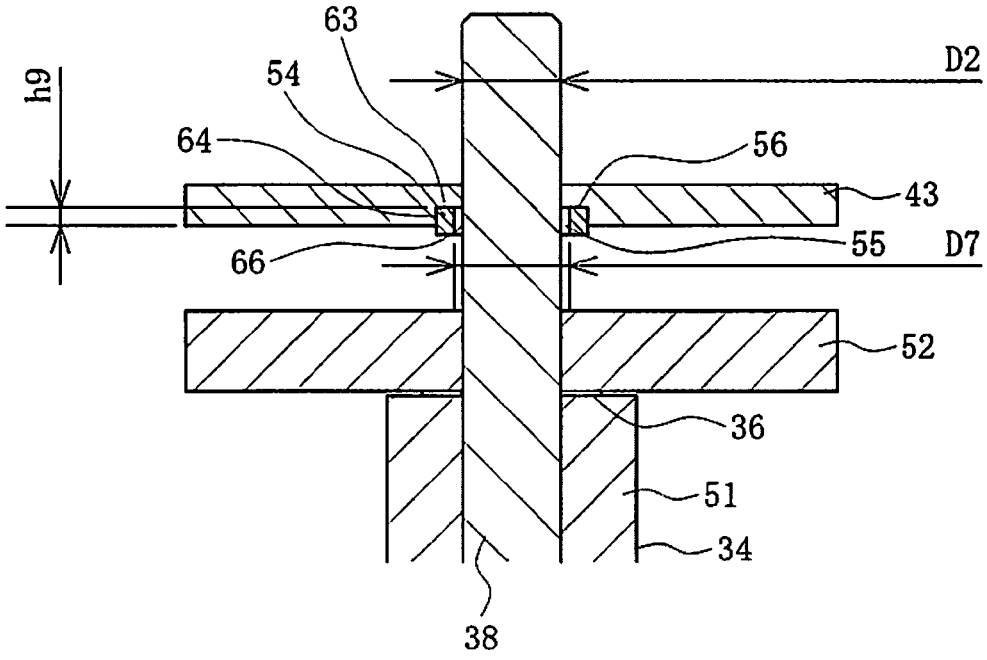
FIG. 10 is a cross-sectional view illustrating the state before the second sponge of the development device and the first sponge held by the step portion of the frame come into contact with each other according to the first embodiment of the invention.
Figure 11:
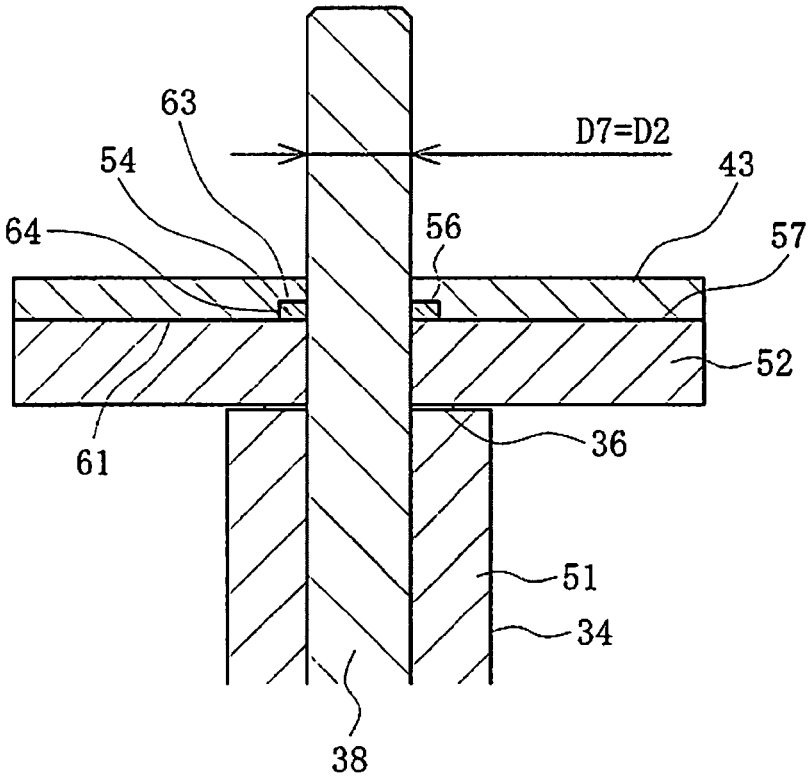
FIG. 11 is a cross-sectional view illustrating the state where the second sponge of the development device and the first sponge held by the step portion of the frame come into contact with each other according to the first embodiment of the invention.

FIG. 1 is an exploded view illustrating a relevant portion of the development device according to the first embodiment of the invention. FIG. 4 is a cross-sectional view of the supply roller of the development device according to the first embodiment of the invention. FIG. 5 is an enlarged partial cross-sectional view showing the center of hole 53 of the second sponge of the development device according to the first embodiment of the invention. FIG. 6 is an enlarged partial cross-sectional view showing the center of hole 62 of the frame of the development device according to the first embodiment of the invention. FIG. 7 is a cross-sectional view of a first sponge of the development device according to the first embodiment of the invention. FIG. 8 is a cross-sectional view of the washer of the development device according to the first embodiment of the invention. FIG. 9 is a cross-sectional view illustrating a state where the first sponge of the development device is held by a step portion of the frame according to the first embodiment of the invention. FIG. 10 is a cross-sectional view illustrating a state before the second sponge of the development device and the first sponge held by the step portion of the frame come into contact with each other according to the first embodiment of the invention. Lastly, FIG. 11 is a cross-sectional view illustrating a state where the second sponge of the development device and the first sponge held by the step portion of the frame come into contact with each other according to the first embodiment of the invention.

Note that, the end portions of supply roller 34 serving as the rotation member have the same configuration at both ends in the axial direction. Therefore, the end portion at one of the ends is only described here.

As illustrated in FIG. 1, supply roller 34 is provided with shaft 38 serving as a shaft portion, and silicon sponge 51 attached around shaft 38 as a roller section. Further, at the end portion of supply roller 34, washer 36 is fitted to shaft 38 which is exposed by protruding from an end portion of silicon sponge 51 in the axial direction. Moreover, second sponge 52 includes hole 53 into which shaft 38 is inserted, and is disposed at a position nearer to the axial end portion of supply roller 34 than is washer 36. In other words, second sponge 52 is disposed at the opposite side of washer 36 from silicon sponge 51. Accordingly, washer 36 is positioned between second sponge 52 and silicon sponge 51. Shaft 38 is rotatably held by a not-illustrated bearing section formed in chassis 35. The bearing section is provided outside frame 43 in the axial direction of shaft 38 (the opposite side from the side at which supply roller 34 is disposed).

In FIG. 1, 54 denotes the first sponge having hole 55 into which shaft 38 is inserted and serving as a first seal member.

Further, frame 43 is provided with step portion 56 having a predetermined height which holds first sponge 59, and contact section 57 which comes into contact with second sponge 52.

As illustrated in FIG. 4, when the outer diameter of supply roller 34, or in other words, the outer diameter of silicon sponge 51, is set as D1, and the outer diameter of shaft 38 is set as D2, data of supply roller 34 is as follows.

Outer diameter D1: ϕ15.4 [mm]
Outer diameter D2: ϕ5.985 [mm]
Hardness: 51±5 (Asker F)
Compression stress $S_{25}$: 45 KPa Here, silicon sponge 51 is made by foam-molding silicon rubber. The hardness and the compression stress $S_{25}$ (when being pressed to the compression stress of 25 [%] of the thickness of a test piece, measured by JIS K 6400-2) of silicon sponge 51 are preferably about 51±5 (Asker F) and 45 Kpa, respectively.

With reference to FIG. 5, 61 denotes a face of second sponge 52 that is opposite from the face which faces silicon sponge 51 of supply roller 34. An amount of developer 31 small enough not to scatter is applied to the inner wall face of hole 53 to reduce friction. As illustrated in FIG. 5, when the thickness of second sponge 52 is set as t1, and the diameter of hole 53 is set as D3, data of second sponge 52 is as follows:

Hole diameter D3: ϕ5.8 [mm]
Thickness t1: 5 [mm]
Hardness: 80±5 (Asker F)
Compression stress $S_{25}$: 70 KPa Here, the hardness and the elasticity of second sponge 52 is higher than those of first sponge 54. The hardness and the compression stress $S_{25}$ of second sponge 52 are preferably about 80±5 (Asker F) and 70 Kpa, respectively. Note that, it is possible to change the hardness and the elasticity by adjusting the amounts of a catalyst and a foaming agent used when the urethane sponge is made.

As illustrated in FIG. 6, frame 43 includes step portion 56 and contact section 57. Step portion 56 is configured to include hole 62 into which shaft 38 is inserted, first restraint section 63 (first restraint surface) which restrains first sponge 54 in the axial direction of shaft 38, and second restraint section 64 (second restraint surface) which restrains first sponge 54 in the radial direction of shaft 38. Further, when the thickness of frame 43 is set as t2, the step height of step portion 56 is set as h9, the diameter of second restraint section 64, or in other words, the hole diameter of second restraint section 64 is set as D4, and the diameter of hole 62 is set as D5, data of frame 43 is as follows:

Thickness t2: 2.5 [mm]
Hole diameter D4: ϕ9 [mm]
Hole diameter D5: ϕ6.1 [mm]
Height h9: 1 [mm]

With reference to FIG. 7, an amount of developer 31 small enough not to scatter is applied to an inner wall face of hole 55 to reduce friction. As illustrated in FIG. 7, when the thickness of first sponge 54 is set as t12, the outer diameter of first sponge 54 is set as D6, and the diameter of hole 55 is set as D7, data of first sponge 54 is as follows:

Outer diameter D6: ϕ9 [mm]
Hole diameter D7: ϕ6.2 [mm]
Thickness t12: 1.5 [mm]
Hardness: 40±5 (Asker F)
Compression stress $S_{25}$: 40 KPa Here, thickness t12 is larger than step height h9 of step portion 56 in the axial direction of shaft 38. Moreover, the relation of D7>D2 is established between hole diameter D7 of hole 55 and outer diameter D2 of shaft 38. As described later, because first sponge 54 is pressed by second sponge 52, the hardness and the elasticity thereof are lower than those of second sponge 52. The hardness and the compression stress $S_{25}$ of first sponge 54 are preferably about 40±5 (Asker F) and 40 Kpa, respectively. Note that, it is possible to change the hardness and the elasticity by adjusting the amounts of a catalyst and a foaming agent used when the urethane sponge is made.

As illustrated in FIG. 8, when the thickness of washer 36 is set as t3, the outer diameter thereof is set as D8, and the inner diameter thereof is set as D9, data of washer 36 is as follows.

Outer diameter D8: ϕ11 [mm]
Inner diameter D9: ϕ6.1 [mm]
Thickness t3: 0.25 [mm]
Material: polyester film
Young's modulus: 4 GP (under JIS K 7127)

FIG. 9 illustrates a state where first sponge 54 is held by step portion 56 of frame 43. In this state, motion of first sponge 54 in the axial direction of shaft 38 is restrained by first restraint section 63 of step portion 56, and motion of first sponge 54 in the radial direction of shaft 38 is restrained by second restraint section 64 of step portion 56.

Here, because thickness t12 of first sponge 54 is set to be larger than height h9 of step portion 56, protrusion section 65 having height h13 is formed. Data of protrusion section 65 is as follows:

Height h13: 0.5 [mm]
Volume V1 of protrusion section 65: 16.71 [$mm^3$]

FIG. 10 illustrates the state before second sponge 52 and first sponge 54, held by step portion 56 of frame 43, come into contact with each other. In this state, because outer diameter D2 of shaft 38 is smaller than hole diameter D7 of hole 55 (D7>D2), gap 66 having height h9 is formed between shaft 38 and first sponge 54. Data of gap 66 is as follows:

Volume V2 of gap 66: 2.06 [$mm^3$]

FIG. 11 illustrates the state where second sponge 52 and first sponge 54 held by step portion 56 of frame 43 come into contact with each other. In this state, first sponge 54 has a hardness and an elasticity lower than those of second sponge 52. Motion of first sponge 54 in the axial direction of shaft 38 is restrained by first restraint section 63 of step portion 56, while motion of first sponge 54 in the radial direction of shaft 38 is restrained by second restraint section 64 of step portion 56. Accordingly, first sponge 54 is pressed in the axial direction of shaft 38 and height h13 of protrusion section 65 becomes 0 [mm]. Therefore, face 61 of second sponge 52 comes into contact with contact section 57 of frame 43. Moreover, the compression direction of first sponge 54 in the radial direction is controlled by second restraint section 64, so that first sponge 54 is pressed in the radial direction of shaft 38. Because the relation of V1>V2 is established in the state before second sponge 52 and first sponge 54 come into contact with each other, volume V2 of gap 66 becomes 0 [$mm^3$] and hole diameter D7 of hole 55 becomes equal to outer diameter D2 of shaft 38 when second sponge 52 and first sponge 54 come into contact with each other. Therefore, first sponge 54 is brought into close contact with shaft 38.

Next, an operation of image formation apparatus 10 having the configuration described above is described.

Figure 12:
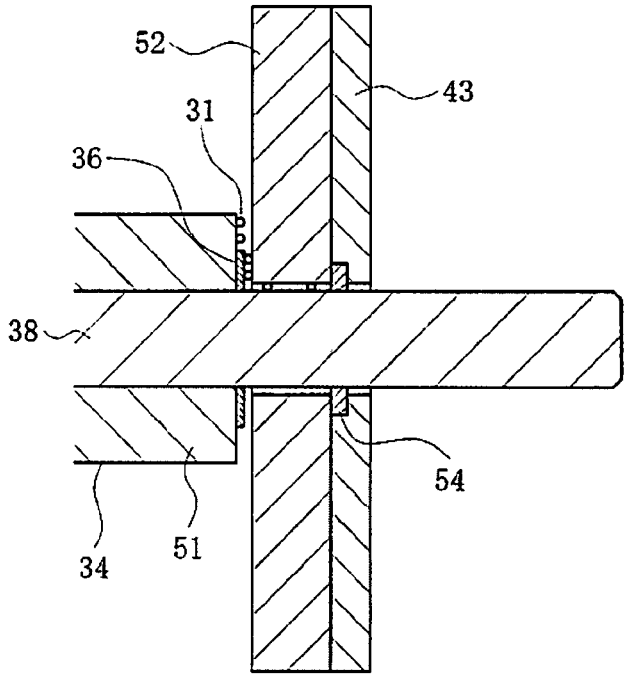
FIG. 12 is a cross-sectional view of a relevant portion of the development device according to the first embodiment of the invention.
Figure 13:
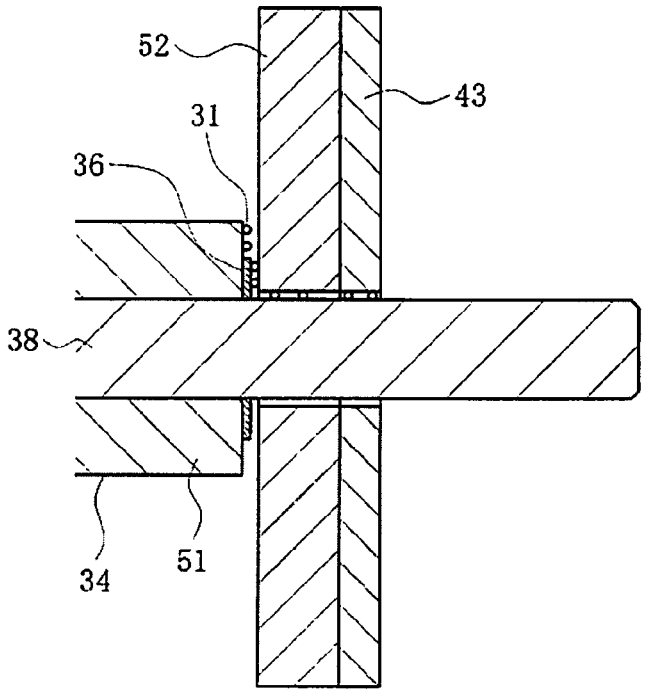
FIG. 13 is a cross-sectional view of a relevant portion of a conventional development device.

FIG. 12 is a cross-sectional view of a relevant portion of the development device according to the first embodiment of the invention, and FIG. 13 is a cross-sectional view of a relevant portion of a conventional development device.

Firstly, upon receiving a print command from a higher-level apparatus such as a personal computer, which is not illustrated, image formation apparatus 10 starts an image formation operation. Further, medium 16 housed in media tray 15 is separated and sent out one by one by separation roller 17, and is sent to transfer belt 19 by conveyance rollers 18*a* and 18*b*. Further, in each development device 11 corresponding to each of the colors, an electrostatic latent image is formed on the surface of photosensitive drum 13. The electrostatic latent image is developed to form a developer image, and the developer image on the surface of photosensitive drum 13 is transferred onto medium 16 conveyed by transfer belt 19.

In this case, supply roller 34 of development device 11 is rotated by a driving source, which is not illustrated, in the direction indicated by arrow 34*a* to supply developer 31 on development roller 33. Moreover, development roller 33 is rotated by a driving source, which is not illustrated, in the direction indicated by arrow 33*a*. Further, developer 31 on development roller 33 is thin-layered by development blade 40 and is charged.

Meanwhile, the surface of photosensitive drum 13, which is rotated by the driving source (not illustrated) in the direction indicated by arrow 13*e*, is uniformly charged by charge roller 41 and selectively exposed by exposure head 14 so that an electrostatic latent image is formed thereon. Note that, the exposed portion has a potential of about 0 [V]. Further, the electrostatic latent image is supplied with developer 31 on development roller 33 and developed to form a developer image.

Subsequently, the developer image formed on the surface of photosensitive drum 13 is conveyed by an electrostatic force from the surface of photosensitive drum 13 to medium 16 transferred by transfer belt 19. Note that, developer 31 residual on the surface of photosensitive drum 13, which is not transferred onto medium 16, is scrapped off and removed by cleaning blade 42 from the surface of photosensitive drum 13. Further, developer 31 thus removed is discharged by spiral 67 to the outside of development device 11 as a waste developer.

Moreover, medium 16 on which the developer image is transferred is sent into fixing unit 20. Further, the developer image transferred onto medium 16 is fixed to medium 16 by heat and pressure. Medium 16 to which the developer image is fixed by fixing unit 20 is discharged by discharge rollers 21*a*, 21*b*, 22*a*, and 22*b* to the outside of image formation apparatus 10, and placed on stacker cover 23.

In conventional technologies as illustrated in FIG. 13, at the end portion of supply roller 34, when developer 31 enters the gap between silicon sponge 51 and second sponge 52, developer 31 might leak out to the outside of frame 43 because there is no sealing mechanism on the frame 43 side of second sponge 52 (the opposite side from silicon sponge 51).

In contrast, according to this embodiment, at the end portion of supply roller 34, as illustrated in FIG. 12, even when developer 31 enters the gap between silicon sponge 51 and second sponge 52, developer 31 does not leak out to the outside of frame 43 because first sponge 54 is disposed between second sponge 52 and frame 43, and first sponge 54 is in close contact with shaft 38.

Consequently, in this embodiment, second sponge 52 is disposed at the end side of silicon sponge 51 of supply roller 34, and first sponge 54 is disposed at the opposite side of second sponge 52 from silicon sponge 51. Further, first sponge 54 has a hardness and an elasticity lower than those of second sponge 52, and motion of first sponge 54 in the axial direction of shaft 38 is restrained by first restraint section 63 of step portion 56 formed on frame 43 while motion of first sponge 54 in the radial direction of shaft 38 is restrained by second restraint section 69 of step portion 56. Accordingly, when second sponge 52 and first sponge 54 come into contact with each other to press first sponge 54 in the axial direction of shaft 38, height h13 of protrusion section 65 becomes 0 [mm]. Therefore, face 61 of second sponge 52 comes into contact with contact section 57 of frame 43.

Moreover, when second sponge 52 and first sponge 54 come into contact with each other to press first sponge 54 in the radial direction of shaft 38, volume V2 of gap 66 between first sponge 54 and shaft 38 becomes 0 [$mm^3$] and hole diameter D7 of hole 55 of first sponge 54 becomes equal to outer diameter D2 of shaft 38. Accordingly, first sponge 59 is brought into close contact with shaft 38. Consequently, because first sponge 54 is brought into close contact with shaft 38, first sponge 54 seals shaft 38.

With this, even when developer 31 enters the gap between the end portion of silicon sponge 51 of supply roller 34 and second sponge 52, developer 31 does not leak out of frame 43, or in other words, does not leak to the outside.

Moreover, when washer 36 is rattled after the driving has occurred for a long time, developer 31 may enter the gap with silicon sponge 51 of supply roller 34. Even in this case, first sponge 59 seals shaft 38, and therefore the sealing properties over the long term can be expected to be secured. Note that, in this embodiment, although only one end side of supply roller 34 in the axial direction is described for the simplified explanation, the same applies to the other end side thereof.

Next, a second embodiment of the invention is described. Note that, the same reference numerals are given to components having the same structures as the first embodiment, and the explanation thereof is omitted. Moreover, the explanations of the same operations and effects as in the first embodiment are also omitted.

Figure 14:
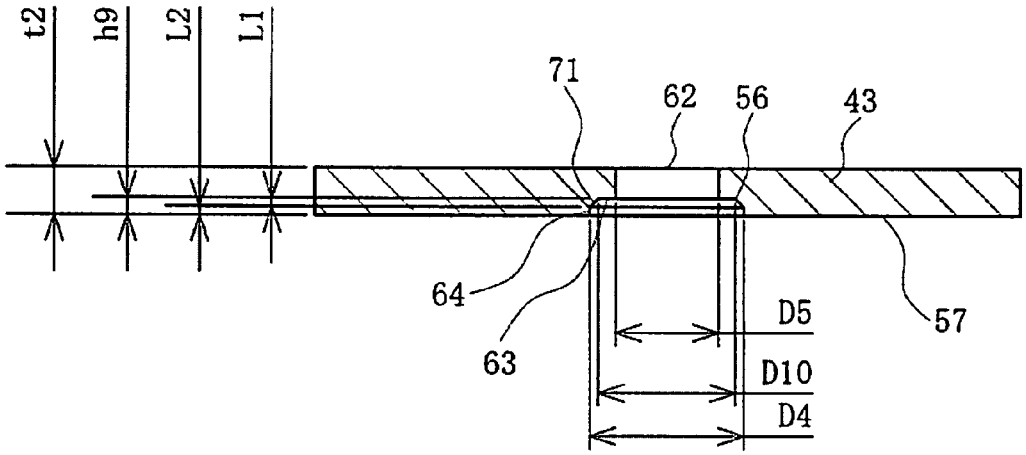
FIG. 14 is a cross-sectional view of a frame of a development device according to a second embodiment of the invention.
Figure 15:
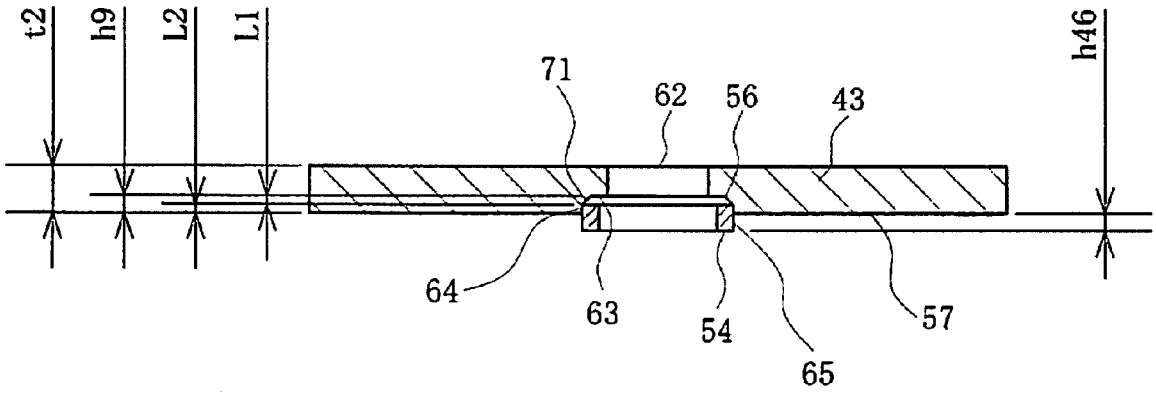
FIG. 15 is a view illustrating the state where a first sponge is held by a step portion of the frame according to the second embodiment of the invention.
Figure 16:
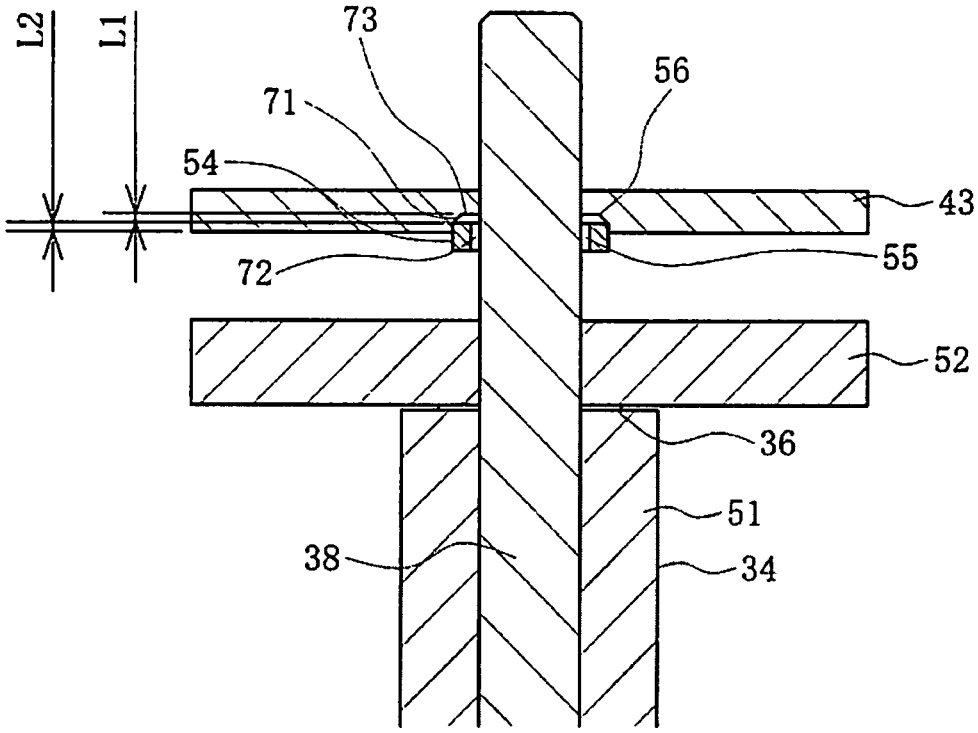
FIG. 16 is a view illustrating the state before a second sponge and the first sponge held by the step portion of the frame come into contact with each other according to the second embodiment of the invention.
Figure 17:
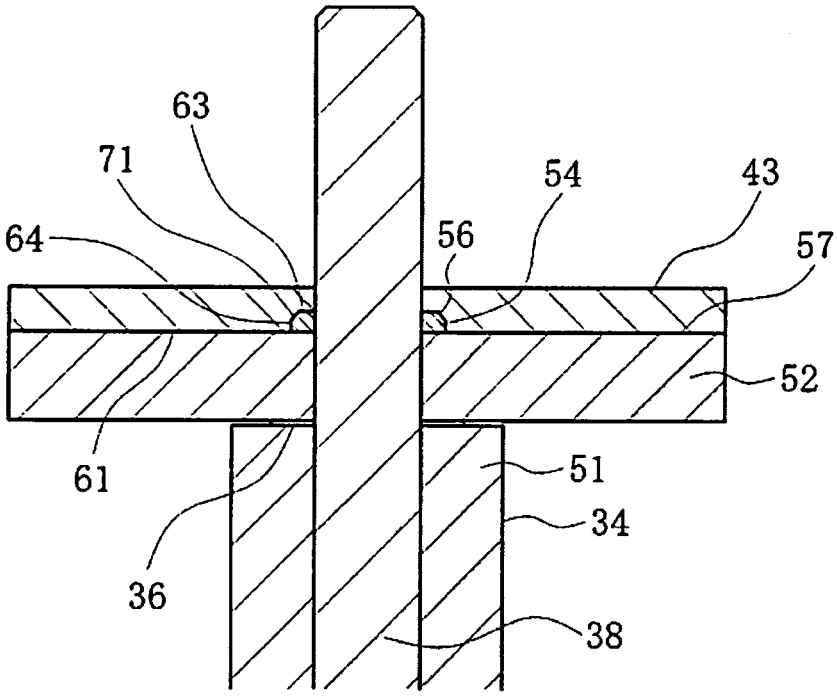
FIG. 17 is a view illustrating the state where the second sponge and the first sponge held by the step portion of the frame come into contact with each other according to the second embodiment of the invention.

FIG. 14 is a cross-sectional view of a frame of a development device according to the second embodiment of the invention. FIG. 15 is a view illustrating the state where a first sponge is held by a step portion of the frame according to the second embodiment of the invention. FIG. 16 is a view illustrating the state before a second sponge and the first sponge held by the step portion of the frame come into contact with each other according to the second embodiment of the invention. Lastly, FIG. 17 is a view illustrating the state when the second sponge and the first sponge held by the step portion of the frame come into contact with each other according to the second embodiment of the invention.

In this embodiment, as illustrated in FIG. 14, step portion 56 formed on frame 43 includes slant 71 which approaches shaft 38 as step portion 56 separates from second sponge 52 in the axial direction of shaft 38. Further, among the data of frame 43, the following is different from the first embodiment:

Length L1 of slant 71 measured from first restraint section 63: 0.5 [mm]

Length L2 from contact section 57 to slant 71: 0.5 [mm]

Diameter D10 in first restraint section 63: 08 [mm]

FIG. 15 illustrates the state where first sponge 54 is held by step portion 56 of frame 43. Here, because thickness t12 of first sponge 54 is set to be larger than length L2 from contact section 57 to slant 71, protrusion section 65 having a height h46 is formed.

Data of protrusion section 65 is as follows:

Height h46: 1 [mm]

Volume V3 of protrusion section 65: 33.42 [$mm^3$]

FIG. 16 illustrates the state before second sponge 52 and first sponge 54 held by step portion 56 of frame 43 come into contact with each other. In this state, because outer diameter D2 of shaft 38 is smaller than hole diameter D7 of hole 55 (D7>D2), gap 72 having a height L2 is formed between shaft 38 and first sponge 54, and gap 73 having a height L1 is formed between shaft 38 and slant 71. Data of gaps 72 and 73 is as follows:

Volume V4 of gap 72: 1.03 [$mm^3$]

Volume V5 of gap 73: 14.34 [$mm^3$]

FIG. 17 illustrates the state where second sponge 52 and first sponge 54 held by step portion 56 of frame 43 come into contact with each other. In this state, first sponge 54 has a hardness and an elasticity lower than those of second sponge 52. Motion of first sponge 54 in the axial direction of shaft 38 is restrained by first restraint section 63 of step portion 56, and motion of first sponge 54 in the radial direction of shaft 38 is restrained by second restraint section 64 of step portion 56. Accordingly, first sponge 54 is pressed in the axial direction of shaft 38 and height h46 of protrusion section 65 becomes 0 [mm]. Therefore, face 61 of second sponge 52 comes into contact with contact section 57 of frame 43. Moreover, because the relation of V3>V4+V5 is established in the state where first sponge 54 is pressed in the radial direction of shaft 38 and before second sponge 52 and first sponge 54 come into contact with each other, when second sponge 52 and first sponge 54 come into contact with each other, the sum of volumes V4 and V5 of gap 72 and gap 73 (V4+V5) becomes 0 [$mm^3$] and hole diameter D7 of hole 55 becomes equal to outer diameter D2 of shaft 38. Therefore, first sponge 54 is brought into close contact with shaft 38. Data of protrusion section 65 and gaps 66, 72, and 73 is as follows:

$$V1-V2=14.65\ [mm^3]$$

$$V3-(V4+V5)=18.05\ [mm^3]$$

Moreover, step portion 56 includes slant 71 which approaches shaft 38 as step portion 56 separates from second sponge 52 in the axial direction of shaft 38. Accordingly, when first sponge 54 is pressed in the axial direction of shaft 38, first sponge 54 is inserted into step portion 56 while being in close contact with slant 71. Therefore, when second sponge 52 and first sponge 54 come into contact with each other, first sponge 54 can be expected to be pressed more strongly in the radial direction of shaft 38.

Note that, the configuration of other elements are similar to that of the first embodiment, and therefore the explanation thereof is omitted.

Next, an operation of image formation apparatus 10 in this embodiment is described.

Similar to the first embodiment, even when developer 31 enters the gap between silicon sponge 51 and second sponge 52 at the end portion of supply roller 34, developer 31 does not leak out to the outside of frame 43 because first sponge 54 is disposed between second sponge 52 and frame 43, and first sponge 54 is in close contact with shaft 38.

Note that, other operations are similar to those of the first embodiment, and therefore the explanation thereof is omitted.

Consequently, in this embodiment, the difference (V3−(V4+V5)) between volume V3 of protrusion section 65 and the sum of volume V4 of gap 72 formed between shaft 38 and first sponge 54 and volume V5 of gap 73 formed between shaft 38 and slant 71 becomes a large value of 18.05 [$mm^3$]. Therefore, first sponge 54 is pressed by this large amount when second sponge 52 and first sponge 54 come into contact with each other.

Note that, in the first embodiment described above, the pressed amount of first sponge 54 (V1−V2) when second sponge 52 and first sponge 54 come into contact with each other is 14.65 [$mm^3$].

Moreover, step portion 56 includes slant 71 which approaches shaft 38 as step portion 56 separates from second sponge 52 in the axial direction of shaft 38. Accordingly, when first sponge 54 is pressed in the axial direction of shaft 38, first sponge 54 is inserted into step portion 56 while being in close contact with slant 71.

Accordingly, when second sponge 52 and first sponge 54 come into contact with each other, first sponge 54 is pressed more strongly in the radial direction of shaft 38. Therefore, the stronger sealing properties can be expected to be secured compared with those of the first embodiment. Other effects are similar to those of the first embodiment, and therefore the explanation thereof is omitted.

Note that, although the case is described in the first and second embodiments where a roller member serving as a rotation member is supply roller 34, the roller member may be a roller of a different type (for example, development roller 33, a stir member, or the like) as long as end portions thereof are sealed by seal members. Moreover, second sponge 52 and first sponge 54 serving as a first seal member and a second seal member are not limited to urethane sponge, and alternatively, may be polyethylene sponge, rubber sponge or the like. In addition, although development device 11 mounted on image formation apparatus 10 is described in the first and second embodiments, development device 11 may be used in a copying machine, a facsimile machine, an MFP, or the like.

Moreover, the invention is applied not only to development device 11 but can be applied to a developer storage container serving as a developer storage device which stores a developer, a waste developer storage container, and the like.

Moreover, the invention is not limited to the above-described embodiments. But various modifications on the basis of the spirit of the invention are possible and are not diverted from the scope of the invention.

The invention can be employed in a development device and in an image formation apparatus.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A developer storage device, comprising:

a rotation member including a main body thereof and a shaft portion which protrudes from an end portion of the main body;

a support member formed with a hole by which the shaft portion is supported;

a first seal member disposed between the main body of the rotation member and the support member and including a hole into which the shaft portion is inserted; and a second seal member disposed between the first seal member and the main body of the rotation member and including a hole into which the shaft portion is inserted, wherein the support member includes a step portion including: a first restraint section configured to restrain motion of the first seal member in an axial direction of the shaft portion; and a second restraint section configured to restrain motion of the outer periphery of the first seal member in a radial direction of the shaft portion.

2. The developer storage device according to claim 1, wherein a size of the first seal member in the axial direction of the shaft portion is larger than a size of the step portion in the axial direction of the shaft portion.

3. The developer storage device according to claim 1, wherein a diameter of the hole of the first seal member is larger than a diameter of the shaft portion.

4. The developer storage device according to claim 1, wherein the second seal member has a hardness greater than a hardness of the first seal member.

5. The developer storage device according to claim 1, wherein the second seal member has an elasticity greater than an elasticity of the first seal member.

6. The developer storage device according to claim 1, wherein the first seal member is in close contact with the shaft portion.

7. The developer storage device according to claim 1, wherein a washer is disposed between the end portion of the main body of the rotation member and the second seal member.

8. The developer storage device according to claim 1, wherein the step portion includes a slant which approaches the shaft portion as the step portion separates from the second seal member in the axial direction of the shaft portion.

9. The developer storage device according to claim 1, wherein the main body of the rotation member is a roller.

10. The developer storage device according to claim 1, wherein the developer storage device is a development device which includes at least one roller, and the main body of the rotation member is the at least one roller in the development device.

11. An image formation apparatus comprising the developer storage device according to claim 1.

12. A developer storage device comprising:

a rotation member including a main body thereof and a shaft portion which protrudes from an end portion of the main body;

a support member formed with a hole by which the shaft portion is supported; and a first seal member disposed between the main body of the rotation member and the support member and including a hole into which the shaft portion is inserted, wherein the support member includes a step portion including: a first restraint section configured to restrain motion of the first seal member in an axial direction of the shaft portion; and a second restraint section configured to restrain motion of the outer periphery of the first seal member in a radial direction of the shaft portion, the second restraint section of the support member is formed in a ring shape surrounding the hole of the support member, and a diameter of the second restraint section is smaller than a diameter of the first seal member, so that the elasticity of the first seal member brings an inner circumference of the hole of the first seal member into close contact with an outer circumference of the shaft portion of the rotation member.

13. The developer storage device according to claim 12, further comprising a second seal member disposed between the first seal member and the main body of the rotation member and including a hole into which the shaft portion is inserted.

14. The developer storage device according to claim 13, wherein the second seal member has a hardness greater than a hardness of the first seal member.

15. The developer storage device according to claim 13, wherein the second seal member has an elasticity greater than an elasticity of the first seal member.

16. The developer storage device according to claim 12, wherein a size of the first seal member in the axial direction of the shaft portion is larger than a size of the step portion in the axial direction of the shaft portion.

17. The developer storage device according to claim 12, wherein a diameter of the hole of the first seal member is larger than a diameter of the shaft portion.

18. The developer storage device according to claim 12, wherein a washer is disposed between the end portion of the main body of the rotation member and the second seal member.

19. The developer storage device according to claim 12, wherein the step portion includes a slant which approaches the shaft portion as the step portion separates from the second seal member in the axial direction of the shaft portion.

20. The developer storage device according to claim 12, wherein the main body of the rotation member is a roller.

21. The developer storage device according to claim 12, wherein the developer storage device is a development device which includes at least one roller, and the main body of the rotation member is the at least one roller in the development device.

22. An image formation apparatus comprising the developer storage device according to claim 12.

* * * * *